United States Patent [19]

Flückiger et al.

[11] 4,298,171

[45] Nov. 3, 1981

[54] WINDING APPARATUS FOR ENDLESS FILAMENTS HAVING AN AUTOMATIC BOBBIN TUBE CHANGER

[75] Inventors: Peter Flückiger; Kurt Schefer, both of Winterthur, Switzerland

[73] Assignee: Rieter Machine Works, Ltd., Winterthur, Switzerland

[21] Appl. No.: 129,625

[22] Filed: Mar. 12, 1980

Related U.S. Application Data

[63] Continuation of Ser. No. 945,330, Sep. 25, 1978, abandoned.

[30] Foreign Application Priority Data

Sep. 23, 1977 [CH] Switzerland ..... 11627/77

[51] Int. Cl.[3] ..... B65H 54/02; B65H 54/42; B65H 67/04

[52] U.S. Cl. ..... 242/18 A

[58] Field of Search ..... 242/18 A, 25 A, 18 DD

[56] References Cited

U.S. PATENT DOCUMENTS

| | | | |
|---|---|---|---|
| 3,279,709 | 10/1966 | Carlson et al. | 242/18 A |
| 3,559,902 | 2/1971 | Brock | 242/18 A |
| 3,825,206 | 7/1974 | Schippers et al. | 242/18 A X |
| 3,856,222 | 12/1974 | Wust | 242/18 A |
| 3,857,522 | 12/1974 | Fink | 242/18 A |
| 3,941,321 | 3/1976 | Bosshard et al. | 242/18 A |

FOREIGN PATENT DOCUMENTS

| | | | |
|---|---|---|---|
| 13360 | of 1913 | United Kingdom . | |
| 822329 | 10/1959 | United Kingdom . | |
| 1104156 | 2/1968 | United Kingdom | 242/18 A |
| 1275562 | 5/1972 | United Kingdom . | |

*Primary Examiner*—Stanley N. Gilreath
*Attorney, Agent, or Firm*—Kenyon & Kenyon

[57] ABSTRACT

The winding apparatus for endless filaments has axially shiftable chucks for the bobbin tubes. The chucks are arranged to pivot on a revolving disc and are brought into contact first with a central and non-displaceable accelerating ring and, subsequently, with a rotating friction drive drum. The revolving disc is provided with two openings through which the pivotable bobbin chucks pass.

25 Claims, 5 Drawing Figures

WINDING APPARATUS FOR ENDLESS FILAMENTS HAVING AN AUTOMATIC BOBBIN TUBE CHANGER

This is a continuation of application Ser. No. 945,300 filed Sept. 25, 1978, now abandoned.

This invention relates to a winding apparatus for endless filaments. More particularly this invention relates to a winding apparatus for endless filaments having an automatic bobbin tube changer.

Heretofore, various types of winding devices have been known for winding endless filaments on bobbin tubes. For example, one known winding device such as described in U.S. Pat. No. 3,941,321 (Swiss Pat. No. 574,865) has an accelerating ring arranged on an extension of a friction drive drum so as to be driven independently of the friction drive drum by its own motor. During a bobbin tube change process, a pivoting arm which supports two bobbin chucks for the bobbin tubes is brought into a position in which the almost fully wound package still contacts the friction drive drum and is driven and in which the empty tube is axially shifted and, thus, brought into contact with the accelerating ring. Using the drive of the accelerating ring, the empty tube is accelerated to the desired rotational speed. Thereupon, the bobbin chuck is axially retracted and the pivoting arm is rotated further in such a manner that the new full bobbin is lifted off the friction drive drum and that the empty tube is brought into contact with the friction drive drum. Upon serving the filament thread from the full bobbin and upon transferring the thread to the empty tube, a new bobbin package build is started thereon. This known device however has the disadvantage that during the bobbin tube change process, a carriage or sliding member must move very large masses to and fro linearly, namely the pivoting arm with the bobbin chucks as well as the full bobbin package and the empty tube. Furthermore, this known device requires much space sideways and vertically. As a result, a tiered arrangement of these winding devices is difficult to operate.

Accordingly, it is an object of the invention to provide a winding apparatus of minimum dimensions in which only small masses are to be moved linearly.

It is another object of the invention to provide a winding apparatus in which bobbin tubes can be readily exchanged in an automated manner.

It is another object of the invention to reduce the downtime required to effect a bobbin tube change in a winding apparatus.

Briefly, the invention provides a winding apparatus for endless filaments which comprises a friction drive drum, a rotatable disc having at least two apertures and an accelerating ring disposed concentrically of the disc and having a diameter to project into the plane range of the apertures. In addition, the apparatus has means for rotating the ring independently of the disc and means for pivoting the disc through a predetermined arc. A pair of bobbin chucks which are capable of receiving at least one tube are aligned with and pass through a respective aperture in the disc and means are mounted on the disc for moving each chuck axially with respect to the disc between a working position and a retracted position. Also, the apparatus has means for pivoting each chuck about an axis parallel to and axially offset from the accelerating ring to position a bobbin tube received on one of the chucks in contact with the accelerating ring with the chuck in the retracted position and, subsequently, in contact with the drive drum.

In an advantageous embodiment, each bobbin chuck can be rotatably supported in a hollow cylinder each and can be arranged to pivot about a shaft supported in a rotatable bearing sleeve using a pneumatic or hydraulic pivoting cylinder means connected with the hollow cylinder and pivotably mounted on the revolving disc. Furthermore, each shaft can be arranged to be axially shiftable, this axial movement being transmitted to the bobbin chuck.

The revolving disc can be driven at the center by a drive shaft in which arrangement the revolving disc can be supported on balls in a wall of the frame of the apparatus. The accelerating ring advantageously can be driven by a hollow shaft supported on the drive shaft and in the revolving disc.

These and other objects and advantages of the invention will become more apparent from the following detailed description and appended claims taken in conjunction with the accompanying drawings in which:

Figure 1:
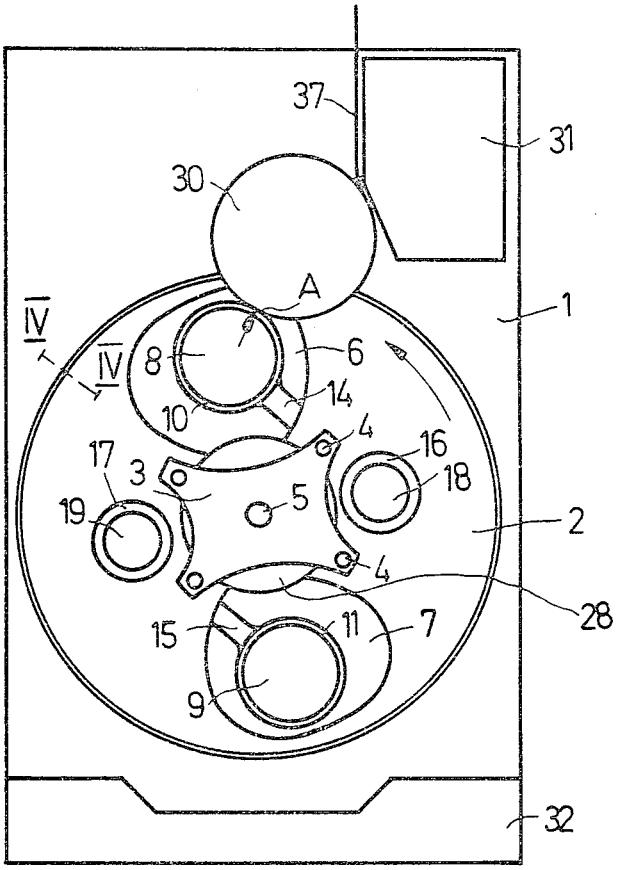
FIG. 1 illustrates a front view of a winding apparatus according to the invention as seen from the winding side.

Referring to FIG. 1, the winding apparatus has a frame wall 1 in which a rotatable carrier such as a revolving disc 2 is rotatably arranged. The revolving disc 2 is rigidly connected to a support diaphram 3 by screws 4. The support diaphram 3 in turn is rigidly connected with a drive shaft 5 (FIG. 5) located coaxially of the disc 2. The revolving disc 2 contains two openings 6, 7 through which two bobbin chucks 8, 9 pass. The bobbin chucks 8, 9 are used for taking up and clamping the bobbin tubes 10, 11 (FIG. 1). The bobbin chucks 8, 9 also can be of such a length that two or more tubes can be taken up side by side per chuck in order to permit simultaneous winding of two or more bobbins.

Figure 3:
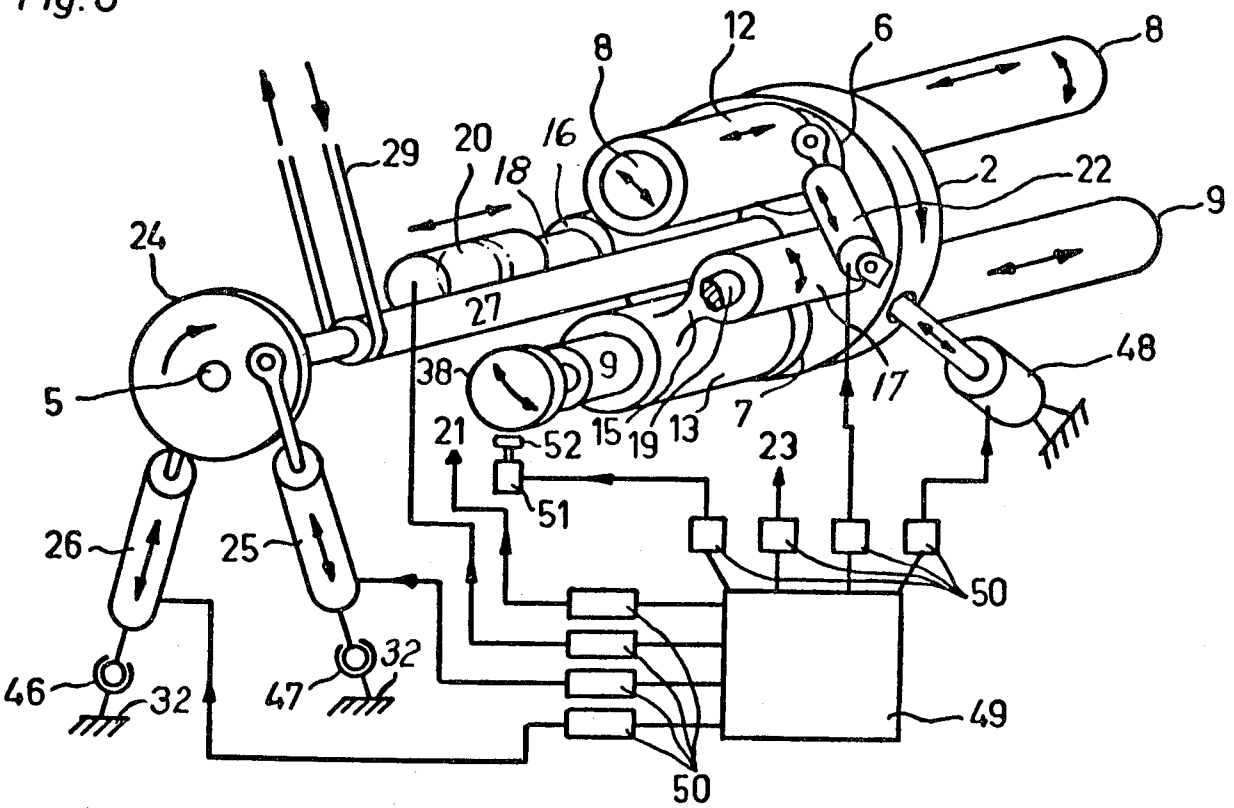
FIG. 3 illustrates an axionometric view of the most important elements of the apparatus connected with the revolving disc as seen from the drive side.

Referring to FIG. 3, the apparatus has a means mounted on the disc 2 for moving each bobbin chuck 8, 9 axially with respect to the disc 2 between a working position and a retracted position as well as means for pivoting each bobbin chuck 8, 9.

Figure 2:
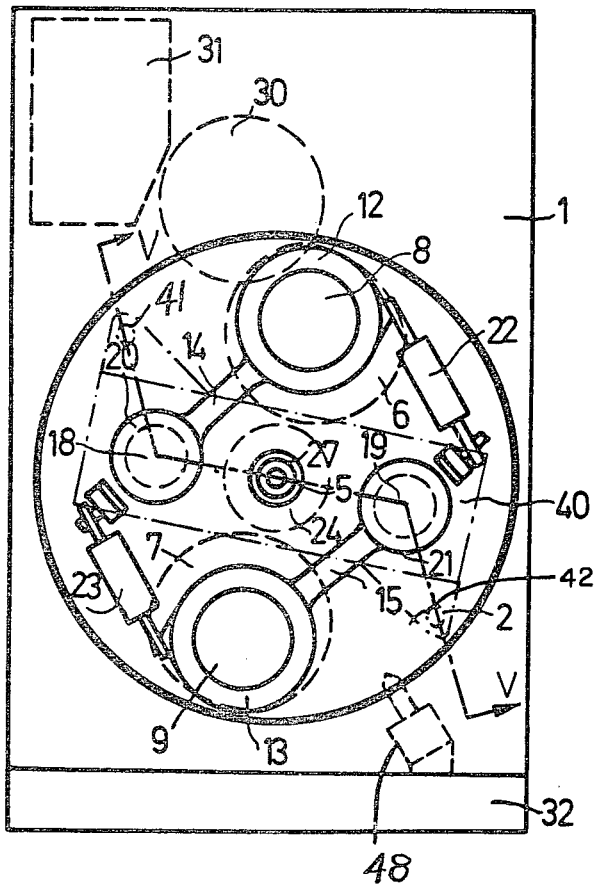
FIG. 2 illustrates a view of the winding apparatus as seen from the drive side.

As shown, the means for pivoting the chucks 8, 9 includes a pair of hollow cylinders 12, 13 on the drive side of the apparatus which are disposed on the bobbin chucks 8, 9 in relatively rotatable manner. The hollow cylinders 12, 13 are fixedly connected via arms 14, 15 with bearing sleeves 16, 17 which are rotatably mounted on shafts 18, 19. Each shaft 18, 19 (FIG. 5) is axially and rotatably mounted in the revolving disc 2 and a support 40 secured to the disc 2 via support rods 41, 42 and bolts 43, 44. In addition, the pivoting means has cylinder means, in the form of pneumatic or hydraulic cylinders 22, 23 (FIG. 2) which are pivotally mounted on the disc 2 and connected to a respective cylinder 12, 13 for pivoting the cylinder 12, 13 about the respective shaft 18, 19. Each bobbin chuck 8, 9 can thus be pivoted about an axis parallel to and radially offset from an accelerating member such as ring 28 (described below) in order to position a bobbin tube received on the chuck 8, 9 in contact with the ring 28 with the chuck in a retracted position and, subsequently, in contact with a friction drive member such as a drive drum 30 (described below).

The means for moving the chucks 8, 9 axially include cylinder means such as pneumatic cylinders 20, 21 mounted on the support member 40 (FIG. 5) for axially moving a respective shaft 18, 19. To this end, the bearing sleeves 16, 17 are mounted on the shafts 18, 19 to move axially therewith. When a cylinder 20, 21 is actuated, the corresponding shaft 18, 19, bearing sleeve 16, 17, cylinder 12, 13 and bobbin chuck 8, 9 are moved axially with respect to the disc 2.

Referring to FIG. 3, when a cylinder 22, 23 is actuated, a bobbin chuck 8, 9 can be pivoted in a radial direction in the zone of the openings 6, 7 about the shaft 18, 19. The openings 6, 7 are sufficiently large, such that sufficient space is available for the desired pivoting movement to be described in the following.

Figure 5:
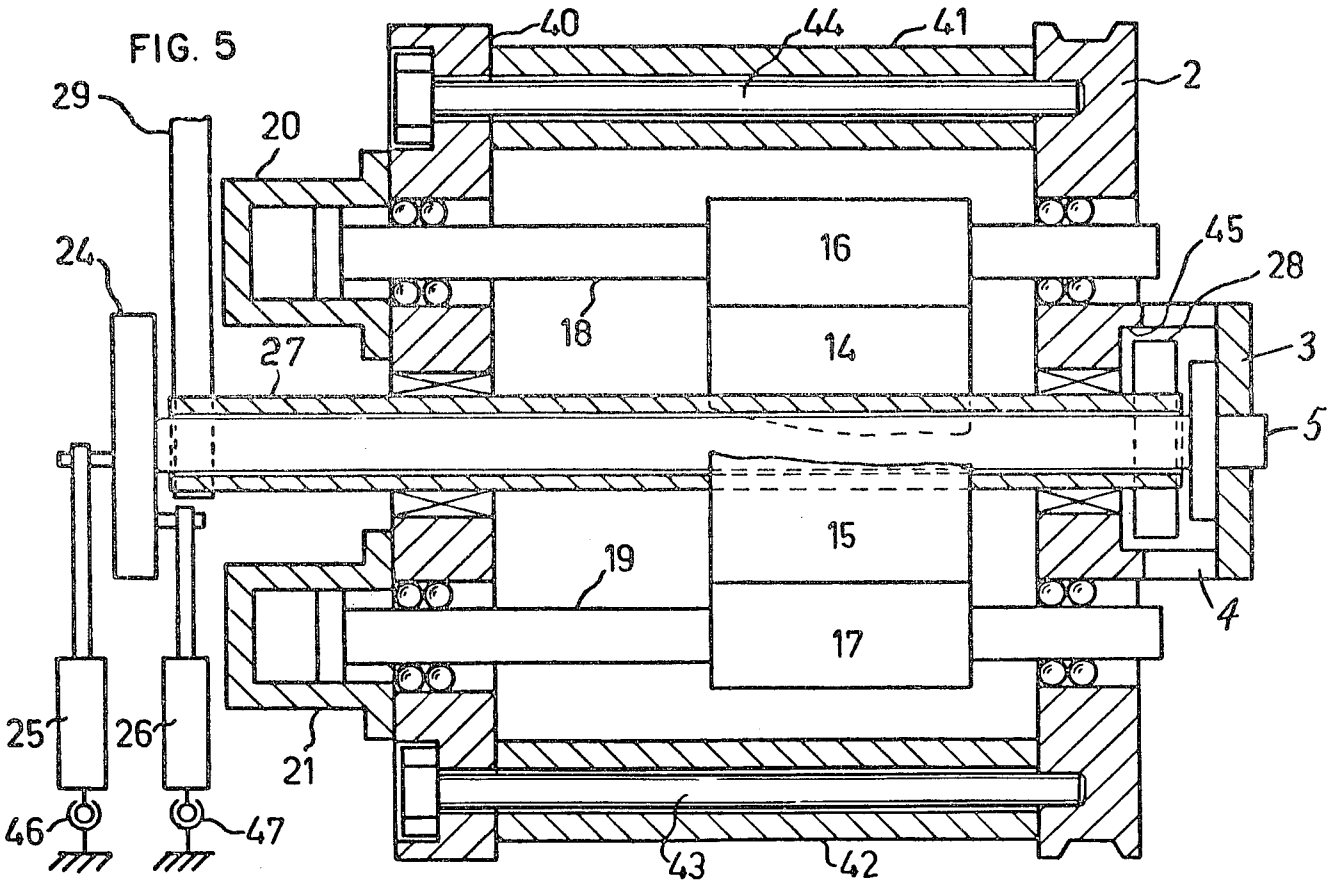
FIG. 5 illustrates a view taken on line V—V of FIG. 2.

Referring to FIGS. 3 and 5, a means for pivoting the disc 2 includes the drive shaft 5 which is connected to the support diaphram 3, a turntable 24 mounted on the opposite end of the drive shaft 5 and a pair of cylinder means such as pneumatic cylinders 25, 26 secured to the turntable at diametrically opposite points. The pivoting cylinder 25 and the auxiliary cylinder 26 (FIG. 3) are pivotably mounted on a bottom member 32 (FIG. 2) of the frame via ball joints 46, 47. The cylinder 25 serves as a drive cylinder to rotate the turntable while the cylinder 26 aids the cylinder 25 in rotating the turntable 24. The two cylinders 25, 26 operate in a "push-pull" manner.

A hollow shaft 27 is supported concentrically about the drive shaft 5 and in the disc 2 in ball bearings (FIG. 5). This hollow shaft 27 is used for driving the accelerating ring 28 (FIG. 5) which is mounted on the end of the hollow shaft 27 in a recess 45 of the revolving disc 2. The means for rotating the ring 28 also includes a drive belt 29 about the shaft 27 so that the ring can be driven independently of the disc.

The accelerating ring 28 is disposed concentrically of the disc 2 and has a diameter to project into the plane range of the apertures 6, 7.

As shown in FIG. 1, the friction drive drum 30 is supported in the wall 1 above the revolving disc 2. A traversing device 31 is also connected with the wall 1 which wall 1 merges into the bottom member 32.

Figure 4:
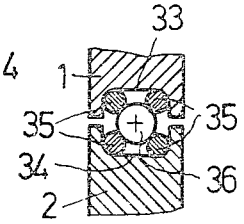
FIG. 4 illustrates a view taken on line IV—IV of FIG. 1 of the support of the revolving disc.

Referring to FIG. 4, the wall 1 and the revolving disc 2 are each provided with a circular groove 33, 34 of approximately rectangular cross-section to receive two circular wires 35 in each for guiding balls 36 in rolling relation. In this arrangement, these elements are sufficiently large so that the revolving disc 2 is supported in a securely balanced position in the wall 1.

All process steps during the winding operation and during the automatic bobbin change in the winding apparatus are controlled by an electronic control unit 49 via electromagnetic valves 50 (FIG. 3). During the winding process, a thread 37 is traversed to and fro by the traversing device 31 and transferred to the friction drive drum 30 and, in known manner, is wound onto the bobbin package being built up on the tube 10 which is placed on the bobbin chuck 8. The bobbin package is driven by the friction drive drum 30. As the tube 10 is mounted on the bobbin chuck 8 in front of the bearing diaphram 3, and as the contacting pressure of the bobbin package being built on the tube 10 onto the friction drive drum 30 is activated by the controlling pivoting cylinder 25 via the rotation of the revolving disc 2 and the drive shaft 5, the bobbin package diameter to be built is limited merely by the mutual distance of the two bobbin chucks and by the bobbin package weight.

Before the almost completed bobbin package built up on tube 10 is automatically exchanged against the empty tube 11, the bobbin chuck 9, onto which the empty tube 11 previously was placed, is retracted by the pneumatic cylinder 21 (FIG. 5) axially so far towards the revolving disc 2 that the end of the tube 11 is brought into the zone of the accelerating ring 28. Using the pivoting cylinder 23 (FIG. 2), the bobbin chuck 9 is now pivoted about the shaft 19 so far that the tube 11 contacts the accelerating ring 28 and is pressed onto the ring 28. Thereupon, the hollow shaft 27 is set into rotation via the drive belt 29 by the motor (not shown) and is accelerated up to the desired speed. Thus, the bobbin tube 11 together with the bobbin chuck 9 is accelerated to the desired speed. In an embodiment with a plurality of tubes placed onto the bobbin chuck, these other tubes are also accelerated to the desired speed. Owing to this arrangement, the contacting pressure of the bobbin chuck 9 does not effect a disturbing influence on the bobbin chuck 8 which carries an almost completed bobbin.

As soon as the bobbin chuck 9 has reached the desired speed, the bobbin change is activated and the pivoting cylinder 25 (FIG. 3) starts rotating the revolving disc 2 in the direction of the arrow according to FIG. 1. The now completely wound bobbin package on tube 10 is lifted off the friction drive drum 30 by this movement and, at the same time, the tube 11 still contacting the accelerating ring 28 approaches the friction drive drum 30. The thread 37 is now severed from the full bobbin in known manner and is transferred to the empty tube 11. After the thread transfer, the bobbin chuck 9 is moved axially forward by the pneumatic cylinder 21 (FIG. 5) towards the winding zone and is simultaneously pivoted by the pivoting cylinder 23 (FIG. 2) about the shaft 19 away from the accelerating ring 28 so far that the bobbin tube 11 already rotating at the desired speed is contactingly pressed against the friction drive drum 30.

As soon as the bobbin tube 11 has reached the position at which the winding process is started each time, the revolving disc 2 is stopped by an arresting device 48 (FIG. 3), and is held in this position. Thereupon, the thread 37 is caught by the thread traversing device 31 in known manner, is traversed to and fro and is wound onto the empty tube 11. In this position, the tube 11 is pressed against the friction drive drum 30 as the pivoting cylinder 23 pivots the bobbin chuck 9 about the shaft 19, the desired contacting pressure being generated by the electronic control unit 49 via a control device of the pivoting cylinder 23. Using this mode of operation, the additional advantage is achieved that the innermost thread layers of the bobbin package can be formed under a contacting pressure freely chosen without any influence of the weight of the full bobbin package.

During the start of the winding process on a new bobbin package on the tube 11, the filled bobbin chuck 8 now located above the frame bottom member 32 is braked by means of a brake shoe 52 which is actuated by a cylinder 51 to act on a braking disc 38 as shown in FIG. 3 at the end of the bobbin chuck 9. The bobbin is then expelled onto a take-up device (not shown). Upon expulsion of the bobbin, the arresting device 48 for the revolving disc 2 is released and the pivoting cylinder 23 is moved out to an end position in such a manner that the revolving disc 2 is brought into a position corresponding to the bobbin package diameter built on the bobbin tube 11. The contacting pressure of the bobbin package being built on the bobbin tube 11 onto the friction drive drum 30 is now effected by the pivoting cylinder 25 which is controlled by the control unit 49, in such a manner that the revolving disc 2 is correspondingly rotated, until the package build is completed. Upon completion of the bobbin package built to the desired bobbin package diameter, the package change process described above is repeated.

The turntable 24 rotates, for example, in approximate 60° increments between two bobbin change operations until one package is full and rotates through 120° during the bobbin change operation. As illustrated, the disc 24 is rotatable in opposite directions for successive bobbin changes. In this manner, the connecting rod of the cylinder 26 will not foul the main drive shaft 14.

The desired speed for the fresh bobbin is approximately the circumferential speed suitable for the commencement of winding. This speed is, in fact, the normal winding speed. The bobbin change is effected either by a push button (manually) or through a relay activated by a predetermined position of arm 15 or 14, i.e. an angle which the arm had described during winding from the empty tube until the full desired package size is reached. This relay is incorporated in the control unit 49.

As described above, there are several means for moving the chuck 8 or 9, namely the cylinders 20, 21 for axial movement, the cylinders 22, 23 for moving the chucks on a circular path about shafts 18, 19 and the cylinders 25 (26) for moving the chucks on a circular path about axis 5 during winding.

As mentioned before, the apparatus also can be applied for simultaneously winding a plurality of threads. In such cases, the bobbin chuck length is chosen so long, that a plurality of bobbin tubes can be taken up, which bobbins are driven by a friction drive drum of corresponding length. For this purpose, a multiple thread traversing device is to be provided.

The invention thus provides an apparatus which is of relatively compact construction with very small vertical height. This is obtained mainly by the displacement of the bobbin chuck which is pivoted in from below the friction drive drum during the bobbin change process. Also, during the exchange process, only the small mass of the bobbin chuck with the empty tube need be displaced linearly.

What is claimed is:

1. A winding apparatus for endless filaments comprising a friction drive drum;

a rotatable disc having at least two apertures therein;

a pair of bobbin chucks, each said chuck capable of receiving at least one bobbin tube thereon and being aligned with and passing through a respective aperture in said disc;

an accelerating ring disposed concentrically of said discs, said ring having a diameter to project into the plane range of said apertures;

means for rotating said ring independently of said disc;

means for pivoting said disc through a predetermined arc for alternately placing said bobbin chucks in position for said bobbin tubes thereon to be engaged by said drive drum for winding endless filaments;

means mounted on said disc for moving each said bobbin chuck axially with respect to said disc between a working position wherein the bobbin tube received on a respective bobbin chuck is axially spaced from a plane containing said accelerating ring and a retracted position wherein the bobbin tube received on a respective bobbin chuck is located in a plane containing said accelerating ring; and means for pivoting each bobbin chuck about an axis parallel to and radially offset from said accelerating ring to position a bobbin tube received on one of said chucks in contact with said accelerating ring when said one bobbin chuck is in said retracted position and to position a bobbin tube received on the other of said chucks in contact with said drive drum when said other bobbin chuck is in said working position.

2. A winding apparatus as set forth in claim 1 wherein means for pivoting a respective bobbin chuck includes a shaft mounted on said disc on said respective axis, a hollow cylinder disposed on said respective bobbin chuck in relatively rotatable manner, a bearing sleeve rotatably mounted on said shaft and fixedly connected to said cylinder in spaced parallel relation, and cylinder means pivotally mounted on said disc and connected to said cylinder for pivoting said cylinder about said shaft.

3. A winding apparatus as set forth in claim 2 wherein said cylinder means is a pneumatic cylinder.

4. A winding apparatus as set forth in claim 2 wherein said means for moving a respective bobbin chuck axially includes a cylinder means connected to said shaft for axially moving said shaft and wherein said bearing sleeve is mounted on said shaft for axial movement therewith.

5. A winding apparatus as set forth in claim 4 which further comprises an arm fixing said cylinder to said sleeve.

6. A winding apparatus as set forth in claim 1 wherein said means for pivoting said disc comprises a drive shaft secured coaxially to said disc at one end, a turntable mounted on said drive shaft at an opposite end, and a pair of cylinder means secured to said turntable at diametrically opposite points for pivoting said turntable and drive shaft.

7. A winding apparatus as set forth in claim 6 wherein said accelerating ring is disposed in a recess of said disc and said means for rotating said ring includes a rotatable hollow shaft supported about said drive shaft and in said disc, said hollow shaft being secured to said accelerating ring.

8. A winding apparatus as set forth in claim 1 which further comprises a frame wall having said disc rotatably mounted therein, said wall and said disc each having a circular groove therein and a pair of round wires in each groove, and a plurality of balls rollably mounted between said wires.

9. A winding apparatus for winding endless filaments into packages comprising a rotatable carrier disposed for rotation on an axis of rotation;

at least two bobbin chucks, each said chuck having a longitudinal axis;

mounting means on said carrier enabling rotation of each said chuck about said axis thereof;

a friction drive member spaced from said axis of rotation of said carrier for successively rotating each said bobbin chuck about said axis thereof upon contact with a bobbin on a respective chuck with said respective chuck brought into a predetermined winding position relative to said drive member; and an accelerating member for accelerating a bobbin chuck prior to said bobbin chuck being brought into said winding position;

said mounting means including a controllable means for controllably moving said respective bobbin chuck between radially inner and outer positions relative to said axis of rotation of said carrier wherein in said inner position, said respective chuck can be driven by said accelerating member and in said outer position, said respective chuck can be located in said winding position by angular disposition of said carrier about said axis of rotation thereof.

10. A winding apparatus as claimed in claim 9, wherein said accelerating member is rotatable about said axis of rotation of said carrier.

11. A winding apparatus as claimed in claim 10, wherein said accelerating member is a ring.

12. A winding apparatus as claimed in claim 9, wherein said controllable means comprises pressure fluid operated means.

13. A winding apparatus as claimed in claim 9, wherein said carrier has associated therewith means to hold said carrier stationary during doffing of a wound package, said controllable means then being operable to urge said respective bobbin chuck towards said friction drive member.

14. A winding apparatus as claimed in claim 9 wherein said mounting means comprises a pivot axis fixed relative to said carrier and a chuck support member supporting said respective chuck and pivotable about said pivot axis to move said respective bobbin chuck between said positions.

15. A winding apparatus as claimed in claim 9 wherein said mounting means further comprises means operable to move said respective bobbin chuck along said longitudinal axis thereof between a working position and a retracted position, said accelerating member being so located relative to said chucks that said chucks must be withdrawn to their retracted positions to enable contact with said accelerating member.

16. A winding apparatus as claimed in claim 15 wherein said means for moving a bobbin chuck axially comprises pneumatic cylinder means.

17. A winding apparatus as claimed in claim 9 wherein said carrier is provided with bearing means mounting the carrier directly in a surrounding portion of a supporting machine frame.

18. A winding apparatus as claimed in claim 9 wherein said carrier comprises a disc having a rim, said apparatus further comprising a machine frame having a portion surrounding said disc and bearing means between said rim of said disc and said surrounding portion of said machine frame.

19. A winding apparatus as claimed in claim 18 wherein said bearing means comprises rolling elements located between facing surfaces of said rim of said disc and said surrounding portion of said machine frame.

20. A winding apparatus according to claim 15 wherein said mounting means comprises a chuck support movably mounted on said carrier for movement with a chuck both axially thereof and between said radially inner and outer positions, said chuck being rotatably mounted in said support.

21. A filament winding apparatus comprising, a frame;

a rotatable chuck carrier disposed for rotation on an axis of rotation fixed relative to said frame;

at least two bobbin chucks, each said chuck having a longitidinal axis;

mounting means on said carrier enabling rotation of a respective chuck about said longitudinal axis thereof;

a friction drive member rotatable about an axis fixed relative to said frame and spaced from said axis of rotation of said carrier, said carrier being rotatable on said axis thereof to bring said bobbin chucks successively into winding dispositions such that bobbins carried thereby in use contact said friction drive member and are driven thereby to rotate said bobbin chucks about said longitudinal axes;

filament guide means for supplying filament to a bobbin chuck in a winding disposition to wind a filament package on a bobbin carried thereby;

carrier rotating means controllably operable to rotate said chuck carrier about said axis of rotation thereof to move said axis of a bobbin chuck relative to said friction drive member during winding of a package on a bobbin carried by said chuck, said carrier rotating means being further operable to hold the carrier stationary relative to said frame during doffing of a completed package; and each said mounting means comprising chuck moving means controllably operable to move the corresponding chuck axis relative to said carrier, and therefore relative to said friction drive member, during an initial stage of winding of a package while said carrier is stationary to enable doffing of a competed package.

22. A winding apparatus according to claim 21 wherein said mounting means comprises a chuck support pivotally mounted on said carrier and said chuck, said moving means being adapted to pivot said chuck support.

23. A winding apparatus as claimed in claim 22 and further comprising an accelerating means for accelerating a bobbin chuck before said chuck reaches said winding disposition, and wherein said moving means is adapted to move said bobbin chuck relative to said carrier between first and second positions in one of which said bobbin chuck can contact said accelerating means and in the other of which said chuck can contact said friction drive member.

24. A winding apparatus as claimed in claim 23 wherein said mounting means further comprises means operable to move a respective bobbin chuck along the longitudinal axis thereof between a working position and a retracted position, said accelerating means being located relative to said chucks whereby in said retracted position a respective chuck can be contacted with said accelerating means.

25. A winding apparatus as claimed in claim 21 wherein said carrier comprises a disc having a rim and said frame comprises a portion surrounding said disc, the apparatus further comprising bearing means provided between said rim of said disc and said surrounding portion of said frame.

* * * * *

UNITED STATES PATENT AND TRADEMARK OFFICE

CERTIFICATE OF CORRECTION

PATENT NO. : 4,298,171

DATED : November 3, 1981

INVENTOR(S) : Peter Fluckiger

It is certified that error appears in the above—identified patent and that said Letters Patent is hereby corrected as shown below:

Column 2, line 68, after "such as" insert --a--.

Column 5, line 11, after "package" change "built" to --build--.

Column 8, line 38, change "competed" to --completed--.

Signed and Sealed this

*Sixteenth* Day of *February 1982*

[SEAL]

*Attest:*

GERALD J. MOSSINGHOFF

*Attesting Officer*

*Commissioner of Patents and Trademarks*